US006967298B2

(12) United States Patent
Schmidt et al.

(10) Patent No.: US 6,967,298 B2
(45) Date of Patent: Nov. 22, 2005

(54) MOTOR SWITCH CELL

(75) Inventors: Robert M. Schmidt, Livonia, MI (US); Mark G. Feldman, Farmington Hills, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/604,938

(22) Filed: Aug. 27, 2003

(65) Prior Publication Data

US 2005/0045463 A1 Mar. 3, 2005

(51) Int. Cl.[7] ..... H01H 3/20
(52) U.S. Cl. ..... 200/330; 200/339
(58) Field of Search ..... 200/330, 339, 200/1 B, 553, 6 R, 16 A

(56) References Cited

U.S. PATENT DOCUMENTS 5,350,889 A * 9/1994 Lauritsen ..... 200/1 B
5,446,253 A * 8/1995 Oshgan ..... 200/556
6,091,038 A * 7/2000 Murphy et al. ..... 200/563
6,118,234 A * 9/2000 Marcellus et al. ..... 318/63
6,180,905 B1 * 1/2001 Pollock et al. ..... 200/527
6,525,284 B2 * 2/2003 Latwesen et al. ..... 200/520
6,559,398 B2 * 5/2003 Takeda et al. ..... 200/339

* cited by examiner

*Primary Examiner*—Kyung Lee

(57) ABSTRACT

A motor switch cell is provided comprising a switch cell actuator slidably engaged to a switch cell base. The switch cell actuator is slidable between a neutral actuator position and a first active actuator position. A first contactor element generates electrical communication between a first neutral contact element and a first active contact element when in the active first contactor position. A first contactor ramp profile is formed on the upper first contactor edge A first contactor pivot is positioned between a first contactor neutral center point and a first active contact. A first roller cam follower assembly rotates the first contactor element to the active first contactor position as the first roller cam follower assembly moves from the first contactor neutral center point towards the first contactor active outer edge in response to the switch cell actuator moving to the first active actuator position.

20 Claims, 5 Drawing Sheets

MOTOR SWITCH CELL

BACKGROUND OF INVENTION

The present invention relates generally to a motor switch cell and more particularly to a motor switch cell with improved operational feel and performance.

Rocker switches are well known in the automotive industry and are utilized for a wide variety of applications. Two of the most common are electronic seat positioning and electronic window controls. In applications such as seat positioning, the switch assemblies must provide a complex range of controls while maintaining simplicity of use.

Existing rocker assemblies often utilize complex configurations having numerous part numbers. This not only increasing the cost and complexity of manufacturing, it can further negatively impact assembly. It would be highly desirable to reduce the number of parts involved in such an assembly in order to reduce cost as well as complexity. In addition, often rocker assemblies utilized bending tools to form their contactor and actuator components. This tooling is costly and can result in a reduced precision part as compared to simple machining procedures such as the punching of flat plates. Thus a rocker switch assembly that utilized parts that could be formed more accurate and cost effective machining methods would be highly beneficial.

Finally, the automotive environment can be a very corrosive one. Small contaminants and debris are known to penetrate rocker switches and may interfere with proper operation. A rocker assembly that utilized switches that helped reduce the effect of such contaminants would prove beneficial. It would therefore be highly desirable to have a new automotive motor switch cell that utilized cost effective manufacturing techniques. It would further be highly desirable to have an automotive motor switch cell with improved contamination tolerance.

SUMMARY OF INVENTION

It is therefore an object of the present invention to provide a motor switch cell with beneficial manufacturing and assembly characteristics. It is a further object of the present invention to provide a motor switch cell with beneficial operational characteristics.

In accordance with the objects of the present invention a motor switch cell is provided comprising a switch cell actuator slidably engaged to a switch cell base. The switch cell actuator is slidable between a neutral actuator position and a first active actuator position. A first neutral contact element is positioned within the switch cell base. A first active contact element is also positioned within the switch cell base. A first contactor element, positioned within the switch cell base, is rotatable between a neutral first contactor position and an active first contactor position. The first contactor element includes an upper first contactor edge and a lower first contactor edge. The first contactor element generates electrical communication between the first neutral contact element and the first active contact element when in the active first contactor position. A first contactor ramp profile is formed on the upper first contactor edge and includes a first contactor neutral center point and a first contactor active outer edge. The first contactor active outer edge is positioned closer to the switch cell actuator than the first contactor neutral center point. A first contactor pivot is positioned between the first contactor neutral center point and the first active contact. A first roller cam follower assembly is mounted to the switch cell actuator and includes a first roller engagement tip rotatably engaging the first contactor ramp profile. The first roller cam follower assembly rotates the first contactor element from the neutral first contactor position to the active first contactor position as the first roller cam follower assembly moves from the first contactor neutral center point towards the first contactor active outer edge in response to the switch cell actuator moving to the first active actuator position.

Other objects and features of the present invention will become apparent when viewed in light of the detailed description and preferred embodiment when taken in conjunction with the attached drawings and claims.

DETAILED DESCRIPTION

Figure 1:
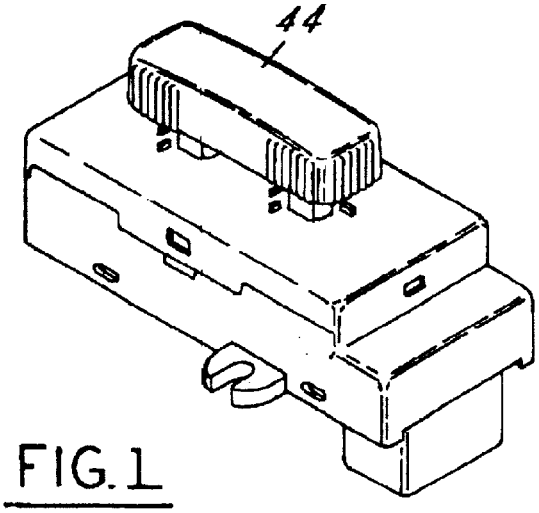
FIG. 1 is an illustration of a multiple direction switch assembly in accordance with the present invention.

Referring now to FIG. 1, which is an illustration of a multiple direction switch assembly 10 in accordance with the present invention. The multiple direction switch assembly 10 illustrated is an embodiment of a six-way directional switch assembly intended for use in an automotive seat positioning assembly. It should be understood, however, that the multiple direction switch assembly 10 and the disclosed switch cells 12 may be utilized in a wide variety of application including non-automotive applications.

Figure 2:
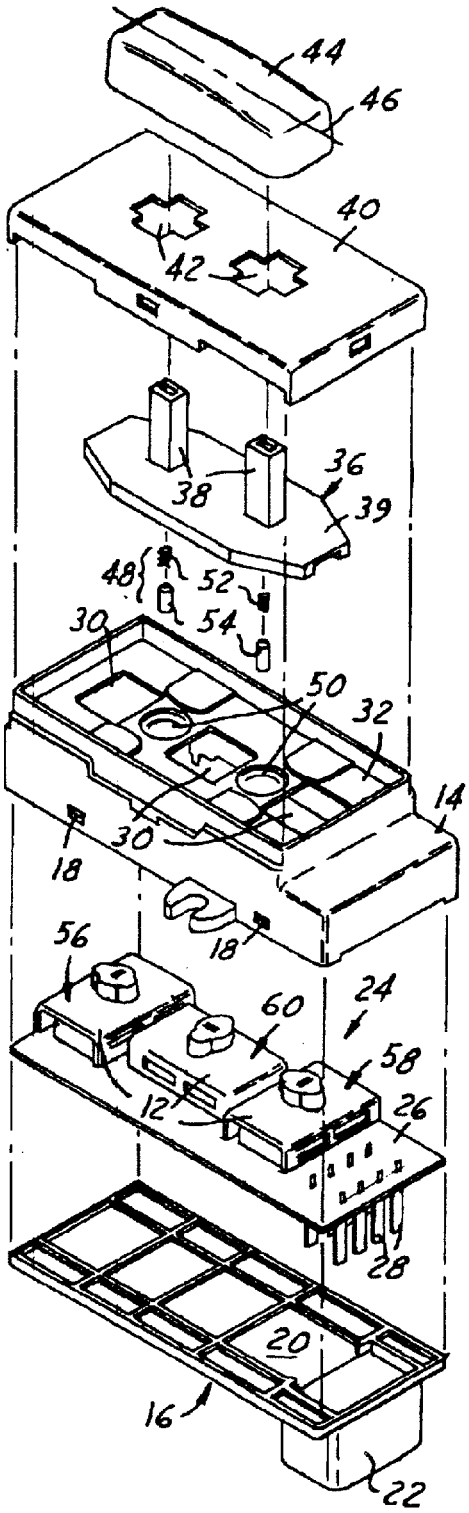
FIG. 2 is an exploded view illustration of the multiple direction switch assembly illustrated in FIG. 1.

An exploded view of an embodiment of the multiple direction switch assembly 10 is illustrated in FIG. 2. The multiple direction switch assembly 10 includes an upper main housing 14 and a lower main housing 16. Although the upper main housing 14 may be attached to the lower main housing 16 in a variety of fashions, one embodiment contemplates the use of snap-fit elements 18. The lower main housing 16 includes a lower main body 20 connected to a connector plug body 22. A switch cell circuit assembly 24 is positioned between the lower main housing 16 and the upper main housing 14. The switch cell circuit assembly 24 includes a switch cell circuit board 26 having a plurality of switch cells 12 electrically mounted to it. A plurality of connector pins 28 are utilized to allow the multiple direction switch assembly 10 to be easily attached to electronic control systems. Although a standard connector plug body 22 is illustrated, it should be understood that a wide variety of connector methodologies may be employed.

The upper main housing 14 preferably includes a plurality of cell engagement slots 30 formed on the upper main housing surface 32. This allows actuator towers 34 formed on the plurality of switch cells 12 to protrude through the upper main housing 14 while the switch cell circuit assembly 24 remains between the lower main housing 16 and the upper main housing 14. An engagement plate 36 can be utilized to provide communication with the actuator towers 34. The engagement plate includes two pillar elements 38 extending upwards from the engagement base 39. The engagement plate 36 preferably sits in contact with the upper main housing surface 32 and is held in place through the use of a guide plate 40. The guide plate 40 includes two 4-way directional slots 42 through which he two pillar elements 38 protrude. A single interface button 44 is mounted to the two pillar elements 38 on the other side of the guide plate 40. In this fashion, by moving the single interface button 44, a plurality of individual switch cells 12 may be controlled. In addition, this control using a single interface button 44 and multiple switch cells 12 provides for the detection of movement of the single interface button 44 in a multitude of directions. Although the two pillar elements 38 may be positioned in a variety of locations (or alternate numbers used), one embodiment contemplates their placement along the single interface button longitudinal centerline 46.

At least one anti-rattle element 48 may be positioned between the upper main housing surface 32 and the engagement plate 36 to insure proper contact and reduce rattle within the high vibration environment of an automobile. One embodiment contemplates the use of a plurality of dish pads 50 formed on the upper main housing surface 32. A tension spring 52 and tension pad 54 are positioned between the engagement plate 36 and the upper main housing surface 32 at the location of each of the plurality of dish pads 50. This suspends the engagement plate 36 to provide a reduced incidence of rattling in the single interface button 44.

The single interface button 44 operates the plurality of switch cells 12 as it is moved. Although a wide variety of number and configuration of the switch cells is contemplated, one embodiment contemplates the use of three switch cells 12. These include a first outer switch cell 56, a second outer switch cell 58, and a center switch cell 60. The first outer switch cell 56 and the second outer switch cell 58 are preferably orientated perpendicular to the single interface button longitudinal centerline 46 and the center switch cell 60 is preferably orientated parallel to the single interface button longitudinal centerline 46. This allows for the multiple direction switch assembly 10 to be utilized to detect rotation of the single interface button 44 as well as movement in a primary direction.

Figure 3:
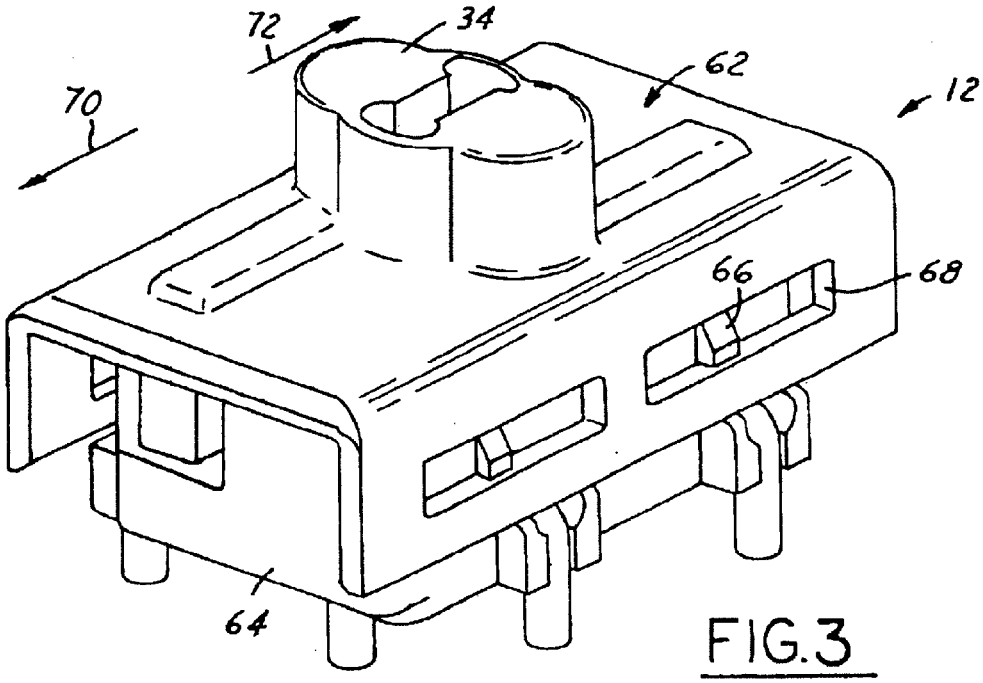
FIG. 3 is an illustration of a motor switch cell in accordance with the present invention.
Figure 10:
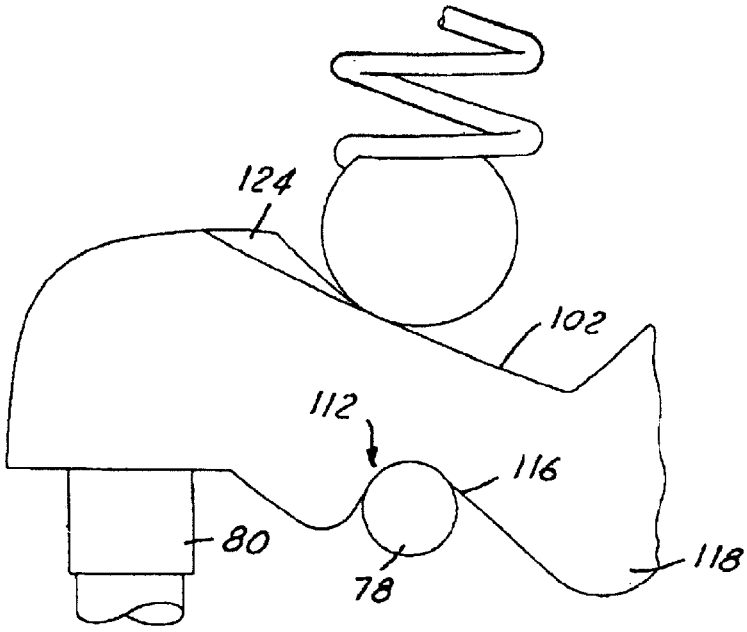
FIG. 10 is a detailed view of the first contactor ramp profile illustrated in FIG. 3.
Figure 5:
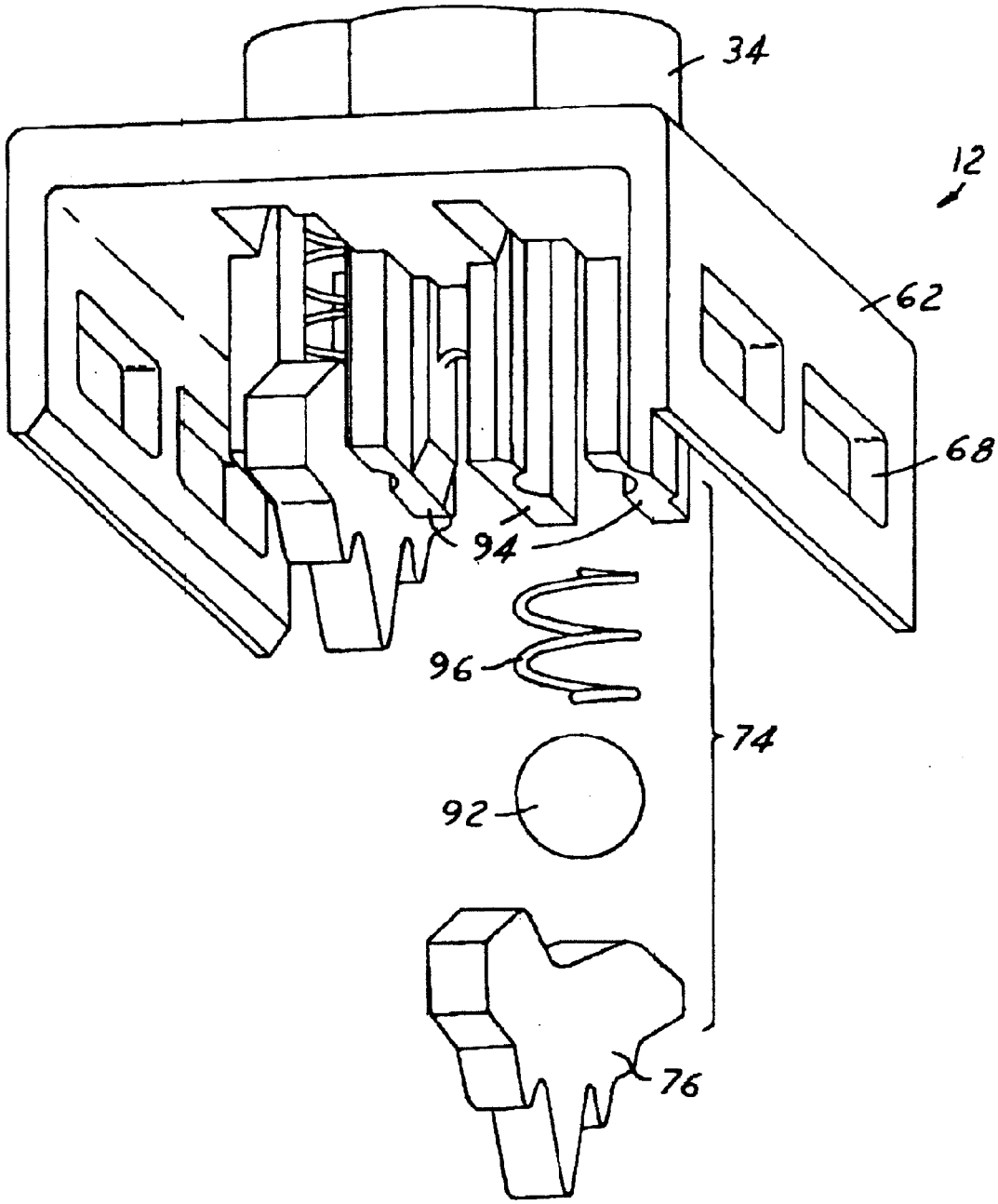
FIG. 5 is a partial detail view of the motor switch cell illustrated in FIG. 4, the detail illustrating the roller cam follower assembly.
Figure 7:
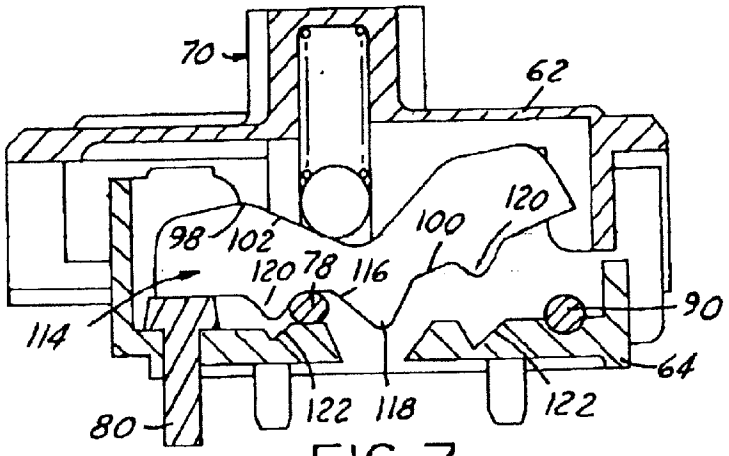
FIG. 7 is a cross-sectional view of the motor switch cell illustrated in FIG. 3, the motor switch cell illustrated in the first active actuator position.
Figure 9:
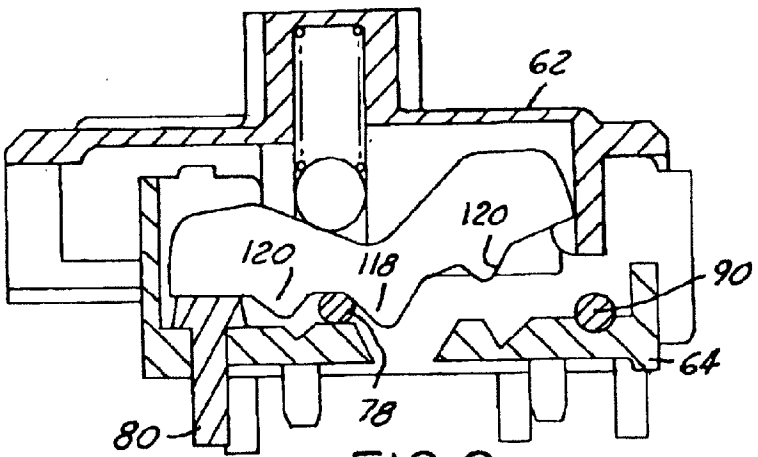
FIG. 9 is a cross-sectional view of the motor switch cell illustrated in FIG. 3, the motor switch cell illustrated in a first contactor stop condition.

The present invention further contemplates that each of the plurality of switch cells 12 may be novel and unique to reduce and simplify construction and assembly in addition to improving performance. An illustration of such a switch cell 12 is shown in FIG. 3. The switch cell 12 includes a switch cell actuator 62 slidably engaged to a switch cell base 64. Although this may be accomplished through a variety of fashions, one embodiment contemplates a plurality of slidable lock protrusions 66 formed on the switch cell base 64 engaging a plurality of slide slots 68 formed on the switch cell actuator 62. The actuator tower 34 may be molded as a single element with the switch cell actuator 62. It is contemplated that the switch cell actuator 62 may be slid in both a first actuator direction 70 and a second actuator direction 72.

Figure 4:
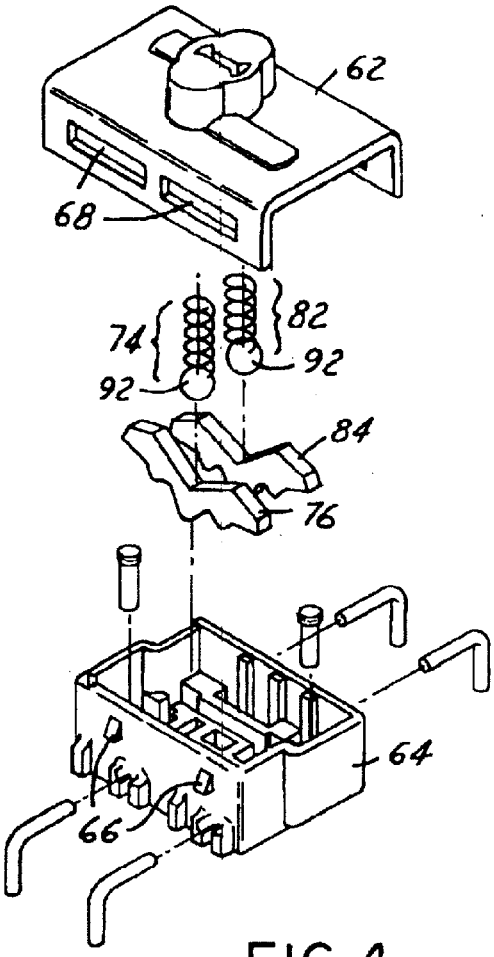
FIG. 4 is an exploded view illustration of the motor switch cell illustrated in FIG. 3.

An exploded view of the switch cell is illustrated in FIG. 4. The switch cell 12 includes a first roller cam follower assembly 74, a first contactor element 76, a first neutral contact element 78, and a first active contact element 80. These elements are utilized by the switch cell 12, when the switch cell actuator 62 is moved in the first actuator direction 70. The switch cell can further include a second roller cam follower assembly 82, a second contactor element 84, a second neutral contact element 86, and a second active contact element 88 for use when moving the switch cell actuator 62 in the second actuator direction 72. The switch cell 12 can further include one or more neutral conductive contacts 90. It should be understood, that FIGS. 6–10 although described in terms of the first elements 74–80 is equally applicable to the second elements 82–88 due to the preferred symmetrical arrangement of the switch cell 12 as illustrated in FIG. 4.

Figure 6:
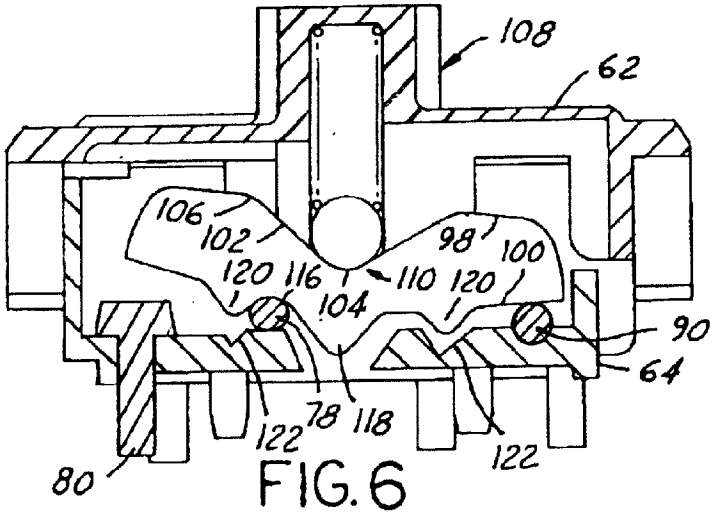
FIG. 6 is a cross-sectional view of the motor switch cell illustrated in FIG. 3, the motor switch cell illustrated in the neutral actuator position.
Figure 8:
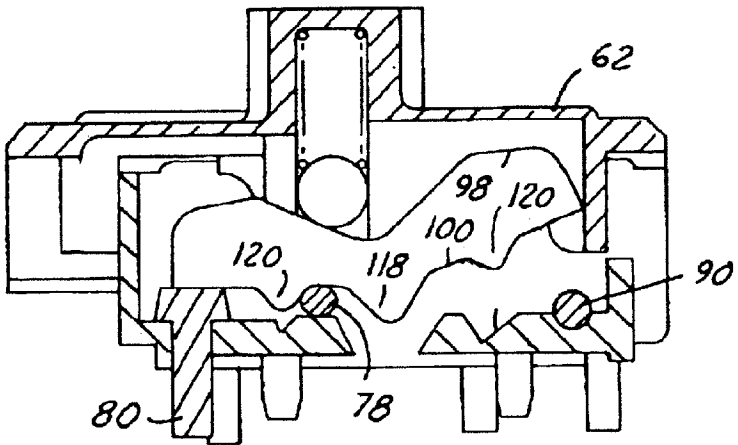
FIG. 8 is a cross-sectional view of the motor switch cell illustrated in FIG. 3, the motor switch cell illustrated in a first contactor motion condition.

A cross-sectional illustration of the switch cell 12 is illustrated in FIG. 6. Although a variety of roller cam follower assemblies 74 are contemplated, one embodiment contemplates the use of a roller engagement tip 92 such as a ball bearing. This provides the opportunity to utilize the roller cam follower assembly 74 for single point force transmission without requiring specialized tooling for manufacture. In a specific embodiment the roller cam follower assembly 74 includes a cage element 94 molded to the switch cell actuator 62. The ball bearing 92 is positioned within the cage element 94 and protrudes from the cage element to contact the contactor element 76. A spring element 96 is positioned between the ball bearing 92 and the switch cell actuator 62 to maintain contact between the ball bearing 92 and the contactor element 76.

The contactor element 76 is preferably a vertically orientated flat plate having an upper first contact edge 98 and a lower first contact edge 100. A first contactor ramp profile 102 is formed into the upper first contact edge 98. The ball bearing 92 contacts the contactor element 76 along this contactor ramp profile 102. The first contactor ramp profile 102 has a ramp slope profile such that the first contactor ramp profile 102 includes a first contactor neutral center point 104 and a first contactor active outer edge 106. The ramp slope profile is such that the first contactor active outer edge 106 is close to the switch cell actuator 62 than the first contactor neutral center point 104 (see FIG. 6). When the switch cell actuator 62 is in the neutral actuator position 108, the ball bearing 92 is positioned within the first contactor neutral center point 104. This holds the first contactor element 76 in a neutral first contactor position 110. In this position the first contactor element 76 generates electrical communication between the first neutral contact element 78 and the neutral conductive contact 90.

As the switch cell actuator 62 is moved towards the first active position 70, the ball bearing 92 moves up the first contactor ramp profile 102. This in turn causes the first contactor element 76 to rotate about a first contactor pivot 112 and into an active first contactor position 114 (see FIG. 7). In this position the first contactor element 76 generates electrical communication between the first neutral contact element 78 and the first active contact element 80. The first contactor ramp profile 102 in combination with the use of the ball bearing 92 insures a force component will bias the ball bearing 92 towards the first contactor neutral center point 104 and thereby provide the assembly with a self biasing state. Although any number of first contact pivots 112 are contemplated, one embodiment contemplates the use of a pivot arch 116 formed in the lower first contactor edge 100. The pivot arch 116 engages the first neutral contact element 78 to generate the first contact pivot 112. The pivot arch 116 is preferably formed with a flat pivot surface 118 such that when the switch cell actuator 62 contacts the first contactor element 76 (see FIG. 8), the first contactor element 76 slides along the first active control element 80 until the first neutral contact element 78 hits a stop (see FIG. 9). This sliding action is highly desirable as it can be utilized to remove any small contaminants or debris that penetrate the switch cell 12 and still allow switch operation.

Although a variety of stops may be utilized, one embodiment contemplates the use of a center of gravity extension 118 formed on the lower first contactor edge 100. The center of gravity extension 118 is utilized to lower the center of gravity of the first contactor element 76 such that it remains in a vertical orientation during assembly. In addition, alignment notches 120 formed on the lower first contactor edge 100 may be used in combination with alignment notches 122 formed on the switch cell base 64 to further assist is maintaining proper alignment of the first contactor element 76 during assembly. It should be noted that the use of a vertically orientated flat plate to form the first contactor element 76 provides improved manufacturing and assembly characteristics as well. The use of a vertically orientated flat plate allows the first contactor ramp profile 102 to be formed cheaply and accurately as compared with bending procedures. In addition, a curved profile portion 124 may be formed of the first contactor ramp profile 102 (preferably adjacent the first contactor active outer edge 106). This can be utilized to prevent the ball bearing 92 from experiencing actuator lock.

Figure 11:
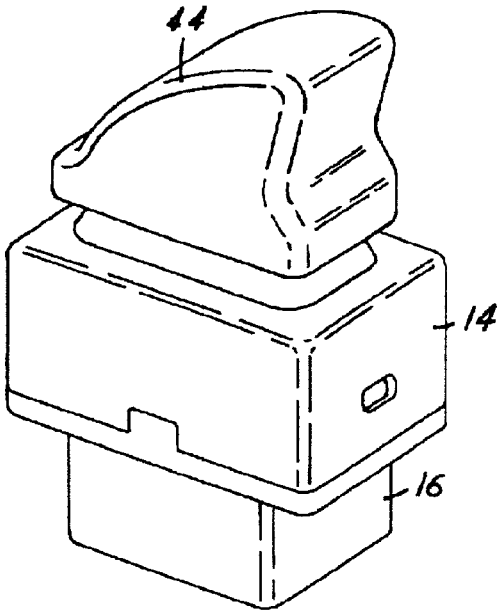
FIG. 11 is an alternate embodiment of a multiple direction switch assembly in accordance with the present invention.
Figure 12:
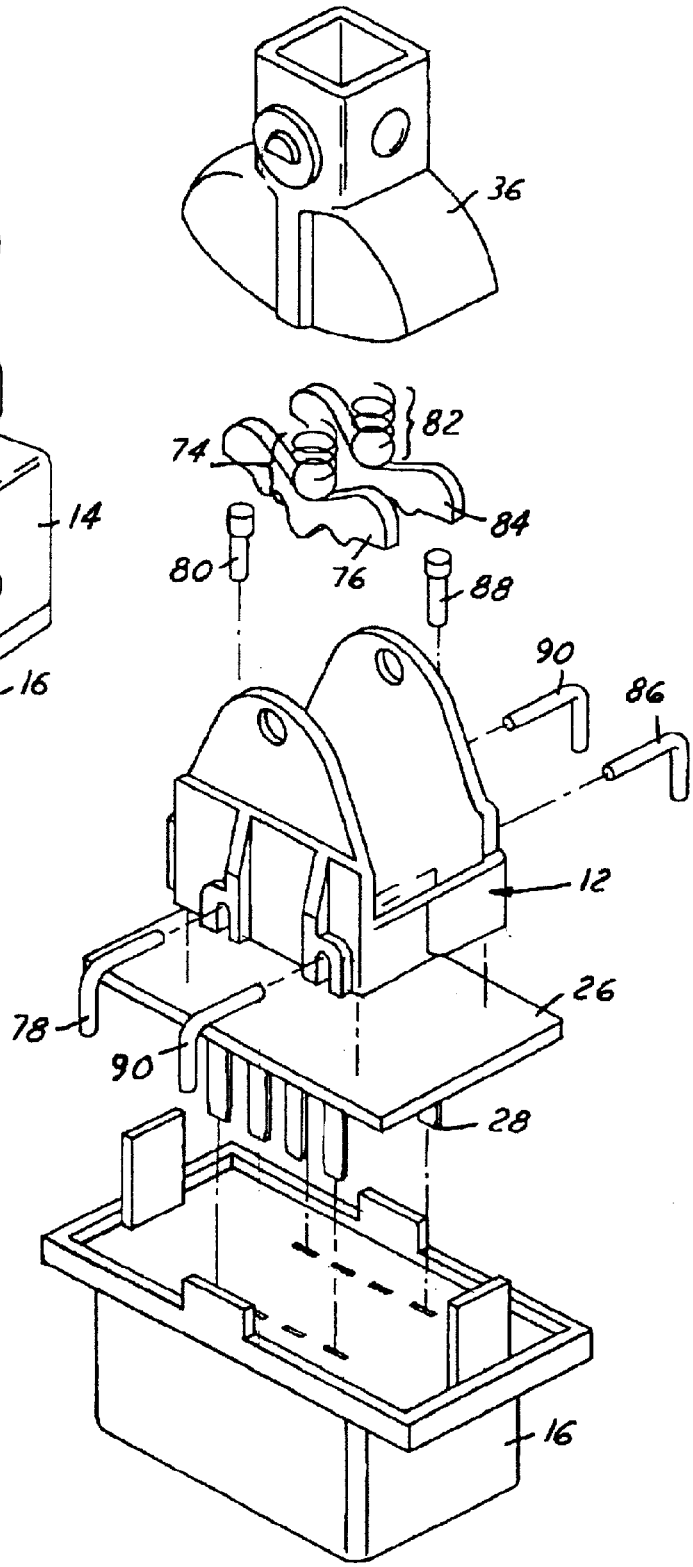
FIG. 12 is an exploded view illustration of the multiple direction switch assembly shown in FIG. 11.

Although the multiple direction switch assembly 10 has thus far been described in terms of a six-degree of freedom switch assembly, it is contemplated that at its simplest the multiple direction switch assembly 10 may only control movement in two directions as illustrated in FIGS. 11 and 12. In this embodiment, the multiple direction switch assembly 10 is optimized for an automotive window operation system.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A motor switch cell comprising:

a switch cell actuator slidably engaged to a switch cell base, said switch cell actuator slidable between a neutral actuator position and a first active actuator position;

a first neutral contact element positioned within said switch cell base;

a first active contact element positioned within said switch cell base;

a first contactor element positioned within said switch cell base, said first contactor element rotatable between a neutral first contactor position and an active first contactor position, said first contactor element including an upper first contactor edge and a lower first contactor edge, said first contactor element generating electrical communication between said first neutral contact element and said first active contact element when in said active first contactor position;

a first contactor ramp profile formed on said upper first contactor edge, said first contactor ramp profile including a first contactor neutral center point and a first contactor active outer edge, said first contactor active outer edge positioned closer to said switch cell actuator than said first contactor neutral center point;

a first contactor pivot positioned between said first contactor neutral center point and said first active contact; and a first roller cam follower assembly mounted to said switch cell actuator, said first roller cam follower assembly including a first roller engagement tip rotatably engaging said first contactor ramp profile, said first roller cam follower assembly rotating said first contactor element from said neutral first contactor position to said active first contactor position as said first roller cam follower assembly moves from said first contactor neutral center point towards said first contactor active outer edge in response to said switch cell actuator moving to said first active actuator position.

2. A motor switch cell as described in claim 1, wherein said first roller engagement tip comprises a ball bearing.

3. A motor switch cell as described in claim 1, wherein said first roller cam follower assembly comprises:

a cage element mounted to said switch cell actuator, said cage element positioned between said switch cell actuator and said first contactor element;

a ball bearing protruding from said cage element, said ball bearing protruding from said cage element to engage said first contactor ramp profile; and a spring element positioned within said cage element between said ball bearing and said switch cell actuator, said spring element holding said ball bearing in contact with said first contactor ramp profile.

4. A motor switch cell as described in claim 1, wherein said first contactor pivot comprises:

a pivot arch having a flat pivot surface formed in said lower first contactor edge of said first contactor element, said first neutral contact element positioned within said pivot arch.

5. A motor switch cell as described in claim 1, further comprising:

a neutral conductive contact positioned within said switch cell base, said first contactor element placing said neutral conductive contact in electrical communication with said first neutral contact when said first contactor element is in said neutral first contactor position.

6. A motor switch cell as described in claim 1, wherein said first contactor element includes a symmetrical axis through said first contactor neutral center point.

7. A motor switch cell as described in claim 1, wherein said first contactor element comprises a vertically orientated flat plate.

8. A motor switch cell as described in claim 1, further comprising:

a curved profile portion formed on said first contactor ramp profile, said curved profile portion positioned adjacent said first contactor active outer edge, said curved profile portion increasing a ramp profile slope.

9. A motor switch cell as described in claim 1, further comprising:

a center of gravity extension formed on said lower first contactor edge, said center of gravity extension biasing said first contactor element to a vertical orientation.

10. A motor switch cell as described in claim 9, wherein said center of gravity extension engages said first neutral contact element and stops said first contactor element when said first contactor element is moved into said active first contactor position.

11. A motor switch cell as described in claim 1, further comprising:

at least one alignment extension formed on said lower first contactor edge, said at least one alignment extension securing said first contactor element within said switch cell base during assembly.

12. A motor switch cell as described in claim 11, further comprising:

at least one alignment notch formed in said switch cell base, said at least one alignment notch positioned to engage said at least one alignment extension during assembly to minimize movement of said first contactor element.

13. A motor switch cell as described in claim 1, further comprising:

a second neutral contact element positioned within said switch cell base;

a second active contact element positioned within said switch cell base;

a second contactor element positioned within said switch cell base, said second contactor element rotatable between a neutral second contactor position and an active second contactor position, said second contactor element including an upper second contactor edge and a lower second contactor edge, said second contactor element generating electrical communication between said second neutral contact element and said second active contact element when in said active second contactor position;

a second contactor ramp profile formed on said upper second contactor edge, said second contactor ramp profile including a second contactor neutral center point and a second contactor active outer edge, said second contactor active outer edge positioned closer to said switch cell actuator than said second contactor neutral center point;

a second contactor pivot positioned between said second contactor neutral center point and said second active contact; and a second roller cam follower assembly mounted to said switch cell actuator, said second roller cam follower assembly including a second roller engagement tip rotatably engaging said second contactor ramp profile, said second roller cam follower assembly rotating said second contactor element from said neutral second contactor position to said active second contactor position as said second roller cam follower assembly moves from said second contactor neutral center point towards said second contactor active outer edge in response to said switch cell actuator moving to a second active actuator position, said neutral actuator position positioned between said first active actuator position and said second active actuator position.

14. A motor switch cell comprising:

a switch cell actuator slidably engaged to a switch cell base, said switch cell actuator slidable between a neutral actuator position and a first active actuator position;

a first neutral contact element positioned within said switch cell base;

a first active contact element positioned within said switch cell base;

a first contactor element positioned within said switch cell base, said first contactor element rotatable between a neutral first contactor position and an active first contactor position, said first contactor element including an upper first contactor edge and a lower first contactor edge, said first contactor element generating electrical communication between said first neutral contact element and said first active contact element when in said active first contactor position;

a first contactor ramp profile formed on said upper first contactor edge, said first contactor ramp profile including a first contactor neutral center point and a first contactor active outer edge, said first contactor active outer edge positioned closer to said switch cell actuator than said first contactor neutral center point;

a pivot arch formed in said lower first contactor edge of said first contactor element, said first neutral contact element positioned within said pivot arch to form a first contactor pivot, said first contactor pivot positioned between said first contactor neutral center point and said first active contact; and a first roller cam follower assembly mounted to said switch cell actuator, said first roller cam follower assembly including a ball bearing rotatably engaging said first contactor ramp profile such that said roller cam follower assembly exerts a normal force on said first contactor ramp profile, said ball bearing rotating said first contactor element from said neutral first contactor position to said active first contactor position as said first roller cam follower assembly moves from said first contactor neutral center point towards said first contactor active outer edge in response to said switch cell actuator moving to said first active actuator position.

15. A motor switch cell as described in claim 14, further comprising:

a neutral conductive contact positioned within said switch cell base, said first contactor element placing said neutral conductive contact in electrical communication with said first neutral contact when said first contactor element is in said neutral first contactor position.

16. A motor switch cell as described in claim 14, further comprising:

a curved profile portion formed on said first contactor ramp profile, said curved profile portion positioned adjacent said first contactor active outer edge, said curved profile portion increasing a ramp profile slope.

17. A multiple direction switch assembly comprising:

a lower main housing;

an upper main housing;

a switch cell circuit assembly positioned between said lower main housing and said upper main housing, said switch cell circuit assembly including a plurality of switch cells, each of said plurality of switch cells comprising:

a switch cell actuator slidably engaged to a switch cell base, said switch cell actuator slidable between a neutral actuator position and a first active actuator position;

an actuator tower formed on said switch cell actuator;

a first neutral contact element positioned within said switch cell base;

a first active contact element positioned within said switch cell base;

a first contactor element positioned within said switch cell base, said first contactor element rotatable between a neutral first contactor position and an active first contactor position, said first contactor element including an upper first contactor edge and a lower first contactor edge, said first contactor element generating electrical communication between said first neutral contact element and said first active contact element when in said active first contactor position;

a first contactor ramp profile formed on said upper first contactor edge, said first contactor ramp profile including a first contactor neutral center point and a first contactor active outer edge; and a first roller cam follower assembly mounted to said switch cell actuator, said first roller cam follower assembly rotatably engaging said first contactor ramp profile, said first roller cam follower assembly rotating said first contactor element from said neutral first contactor position to said active first contactor position as said first roller cam follower assembly moves from said first contactor neutral center point towards said first contactor active outer edge in response to said switch cell actuator moving to said first active actuator position; and a plurality of cell engagement slots formed in an upper main housing surface, each of said plurality of cell engagement slots corresponding to one of said actuator towers, each of said actuator towers extending through one of said plurality of engagement slots;

an engagement plate in communication with said actuator towers, said engagement plate in communication with a single interface button; and a guide plate positioned between said engagement plate and said single interface button;

wherein said single interface button provides actuation control over said plurality of switch cells.

18. A multiple direction switch assembly as described in claim 17, further comprising:

two pillar elements mounted to said engagement plate, said two pillar elements providing communication between said engagement plate and said single interface button; and two four-way directional slots formed in said guide plate, each of said two pillar elements passing through one of said two four-way directional slots.

19. A multiple direction switch assembly as described in claim 17, further comprising:

an anti-rattle element positioned between said engagement plate and said upper main housing.

20. A multiple direction switch assembly as described in claim 18, wherein said plurality of switch cells comprises:

a first outer switch cell orientated perpendicular to a single interface button longitudinal centerline;

a second outer switch cell orientated perpendicular to said single interface button longitudinal centerline; and a center switch cell orientated parallel to said single interface button longitudinal centerline, said center switch cell positioned between said first outer switch cell and said second outer switch cell.

* * * * *